United States Patent [19]

Yoshizawa et al.

[11] Patent Number: 4,717,637

[45] Date of Patent: Jan. 5, 1988

[54] ELECTROPHOTOGRAPHIC PHOTOSENSITIVE MEMBER USING MICROCRYSTALLINE SILICON

[75] Inventors: Shuji Yoshizawa, Tokyo; Wataru Mitani; Mariko Yamamoto, both of Yokohama; Akira Sanjoh, Aichi; Tatsuya Ikezue, Tokyo, all of Japan

[73] Assignee: Kabushiki Kaisha Toshiba, Japan

[21] Appl. No.: 877,318

[22] Filed: Jun. 23, 1986

[30] Foreign Application Priority Data

Jun. 25, 1985 [JP] Japan ..... 60-138221
Jun. 25, 1985 [JP] Japan ..... 60-138223
Jun. 25, 1985 [JP] Japan ..... 60-138224

[51] Int. Cl.[4] ..... G03G 5/14

[52] U.S. Cl. ..... 430/65; 430/66; 430/84

[58] Field of Search ..... 430/57, 64, 66, 84, 430/94, 95, 65

[56] References Cited

U.S. PATENT DOCUMENTS 4,265,991 5/1981 Hirai et al. ..... 430/64
4,420,546 12/1983 Kanbe et al. ..... 430/65
4,560,634 12/1985 Matsuo et al. ..... 430/84
4,582,773 4/1986 Johncock et al. ..... 430/65

FOREIGN PATENT DOCUMENTS

0066812A2 5/1982 European Pat. Off. .
3215151A1 4/1982 Fed. Rep. of Germany .

OTHER PUBLICATIONS

Solar Energy Materials, 11 (1984), pp. 85–95.

*Primary Examiner*—John L. Goodrow
*Attorney, Agent, or Firm*—Schwartz, Jeffery, Schwaab, Mack, Blumenthal & Evans

[57] ABSTRACT

In an electrophotographic photosensitive member according to the present invention, a barrier layer is formed on a conductive substrate; a first layer of a photoconductive layer on the barrier layer, and a second layer on the first layer. Formed of microcrystalline silicon containing hydrogen, the first layer is highly sensitive to long-wavelength light. The second layer contains hydrogen and at least one element selected from carbon, oxygen, and nitrogen. The barrier layer is formed of microcrystalline silicon containing an element included in group III or V of the periodic table. The rectifying action of the barrier layer prevents carriers from being injected into the photoconductive layer from the substrate side. Containing carbon, oxygen, or nitrogen, the barrier layer has high dark resistance and chargeability.

14 Claims, 3 Drawing Figures

ELECTROPHOTOGRAPHIC PHOTOSENSITIVE MEMBER USING MICROCRYSTALLINE SILICON

BACKGROUND OF THE INVENTION

The present invention relates to an electrophotographic photosensitive member with improvements in chargeability, photosensitivity, and environmental durability.

Organic and inorganic materials have conventionally been used to form photoconductive layers of electrophotographic photosensitive members. Among the inorganic materials are CdS, ZnO, selenium, Se-Te system, and amorphous silicon. The organic materials include poly-N-vinyl carbazole (PVCz) and trinitrofluorenone (TNF). In the photosensitive members using these photoconductive materials, however, there are various problems related to their photoconductive characteristics and workmanship. Therefore, the characteristics of the photosensitive system have been sacrificed, in some measure, in using these materials properly, according to the applications.

For example, selenium and CdS are harmful to health, and must be prepared with special care for safety's sake. Accordingly, they require complicated manufacturing apparatuses and thereby entail high production costs. In particular, selenium must be recovered and this necessitates additional cost. Moreover, selenium and Se-Te system, whose crystallization temperature is as low as 65° C., will be confronted with problems related to their photoconductive characteristics, such as residual potential, during repeated copying operations. Therefore, they are short-lived and not very practical.

Further, ZnO is not reliable in use because it is liable to oxidize or reduce, and is highly susceptible to the environmental atmosphere.

It is suspected, furthermore, that organic photoconductive materials such as PVCz and TNF are carcinogens. Besides being harmful to health, they are low in thermal stability and in wear resistance, and are therefore short-lived.

Meanwhile, amorphous silicon (hereinafter abbreviated to a-Si) is a photoconductive material which has recently become the object of public attention. It is frequently applied to solar cells, thin-film transistors, and image sensors. As a part of such applications, a-Si has been tried as a material for electrophotographic photosensitive members. Since a-Si produces no pollutant, photosensitive members formed of a-Si need not be recovered. Also, they have higher spectral sensitivity in the visible radiation area than those made of other materials, and are high in surface hardness, wear resistance, and shock resistance.

Amorphous silicon is being studied as a material in photosensitive members for electrophotography, based on the Carlson process. In this connection, the members must have high resistance and photosensitivity. It is difficult, however, for a single-layer photosensitive member to provide both these characteristics. To meet these requirements, therefore, laminate-type photosensitive members have been developed which are constructed such that a barrier layer is sandwiched between a photoconductive layer and a conductive substrate, and a surface charge retentive layer is formed on the photoconductive layer.

Usually, a-Si is formed by the glow discharge decomposition process, using silane gas. In this process, hydrogen is trapped in an a-Si film, so that the electrical and optical characteristics of the film vary considerably, depending on the hydrogen content. If the amount of hydrogen incorporated in the a-Si film increases, the optical band gap becomes greater, increasing the resistance of the film, so that the film has reduced sensitivity to long wavelength light. It is therefore difficult to use it suitably, for example, in a laser beam printer mounted with a semiconductor laser. If the hydrogen content of the a-Si film is high, $(SiH_2)_n$ and other bonds may sometimes occupy the greater part of the film, depending on the filming conditions. Thereupon, voids spread, thus increasing silicon dangling bonds, lowering the photoconductive characteristics. Thus, the film cannot be used for an electrophotographic photosensitive member. If the amount of hydrogen incorporated in the a-Si film is reduced, on the other hand, the optical band gap is narrowed, reducing the resistance of the film, although the film now has increased sensitivity to longer-wave light. If the hydrogen content is low, however, less hydrogen links with the silicon dangling bonds, thereby reducing them. Accordingly, the mobility of resulting carriers is reduced, and the film is lowered in life performance and photoconductive characteristics. Thus, the film becomes unfit for use in the photosensitive member.

In a conventional method of increasing the sensitivity to longer-wave radiation, silane gas is mixed with germane ($GeH_4$), and is subjected to glow discharge decomposition, thereby forming a film with a narrow optical band gap. In general, silane gas and $GeH_4$ are different in the optimum substrate temperature, so that the resultant film is subject to many structural defects and cannot provide satisfactory photoconductive characteristics. Moreover, waste gas from $GeH_4$ becomes poisonous when it is oxidized, requiring a complicated processing system therefor. In consequence, this technique is not practical.

SUMMARY OF THE INVENTION

The object of the present invention is to provide an electrophotographic photosensitive member which enjoys improved chargeability, low residual potential, high sensitivity over a wide wavelength range, good adhesion to substrate, and improved environmental capability.

According to the present invention, there is provided an electrophotographic photosensitive member which comprises a conductive substrate, a barrier layer provided on the conductive substrate, the barrier layer being formed of microcrystalline silicon containing hydrogen, an element included in group III or V of the periodic table, and at least one element selected from carbon, oxygen, and nitrogen, and a photoconductive layer provided on the barrier layer, the photoconductive layer including a first layer formed of microcrystalline silicon, at least a part of which contains hydrogen, and a second layer formed of amorphous silicon containing hydrogen and at least one element selected from carbon, oxygen, and nitrogen, the first and second layers being stacked in the direction of the thickness of the photoconductive layer.

The present invention is based on the results of various experiments conducted by the inventors hereof. The electrophotographic photosensitive member of the invention at least partially includes microcrystalline silicon (hereinafter abbreviated to $\mu c$-Si) as a photosensitive material, thereby eliminating the aforementioned drawbacks of the prior art and providing good photoconductive or electrophotographic characteristics and high environmental capability.

The present invention is characterized in that μc-Si is used in place of a-Si for the prior art material. The whole region or part of the photosensitive member is formed of μc-Si, or a mixture of μc-Si and a-Si, or a laminate structure of μc-Si and a-Si.

Microcrystalline silicon is clearly distinguished from a-Si and polycrystalline silicon by the following physical properties. In an X-ray diffraction measurement, a-Si develops only halos and produces no diffraction pattern, due to its amorphousness, while μc-Si produces a crystal diffraction pattern with $2\theta$ ranging from 27 to 28.5 degrees. While the dark resistance of polycrystalline silicon is $10^6$ Ω·cm, that of μc-Si is $10^{11}$ Ω·cm or more. Microcrystalline silicon is an aggregate consisting of microcrystalline with a grain diameter of tens of angstroms or more.

The mixture of μc-Si and a-Si is a substance in which the crystal structure of μc-Si is present in a-Si, so that both materials are equal in volume. The laminate structure of μc-Si and a-Si is a structure which includes a layer formed mainly of a-Si and a layer stuffed with μc-Si.

The photoconductive layer including μc-Si, like the one including a-Si, can be formed by depositing μc-Si on a conductive substrate by the high-frequency glow discharge decomposition process, using silane gas as a material. The formation of μc-Si is facilitated if the substrate temperature and high-frequency power are set higher than in the case of the a-Si layer. If the temperature and power are higher, then the flow volume of material such as silane gas can be increased in proportion, permitting faster filming. Further, μc-Si can be formed more efficiently by diluting $SiH_4$, $Si_2H_6$, or another silane gas of higher order, with hydrogen.

The μc-Si has an optical band gap of approximately 1.6 eV, as compared to the 1.65 to 1.7 eV gap of a-Si. In general, a photoconductive layer absorbs those components of incident light which have greater energy than the optical band gap of the layer, and produces carriers correspondingly. Meanwhile, longer-wave light, such as near-infrared radiation, has less energy than visible radiation has. Therefore, a-Si, which has high enough sensitivity to visible light, has only a low sensitivity to near-infrared radiation or other longer-wave light. On the other hand, μc-Si, whose optical band gap is smaller than that of a-Si, has high enough sensitivity to longer-wave light. Thus, it produces carriers when exposed to longer-wave light. In a laser printer mounted with a semiconductor laser, the oscillation wavelength of the laser is 790 nm, falling within the range for near-infrared radiation. If μc-Si is used in a part of the photoconductive layer, as in the present invention, the layer enjoys a high photosensitivity over a wide range covering both visible radiation and near-infrared radiation. Thus, the present invention may be applied to laser printers, as well as plain paper copiers (PPC).

According to this invention, moreover, the μc-Si constituting the barrier layer contains carbon, oxygen and/or nitrogen for higher chargeability.

According to the invention, furthermore, there may be provided an electrophotographic photosensitive member which enjoys high resistance, improved charging capability, and high sensitivity to both visible and near-infrared radiations, and is highly practical and easy to manufacture.

DETAILED DESCRIPTION OF THE PREFERRED EMBODIMENTS

Figure 1:
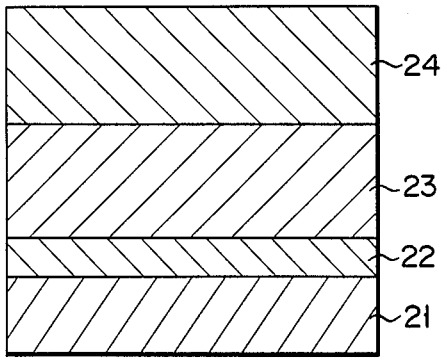
FIGS. 1 and 2 are partial sectional views showing electrophotographic photosensitive members according to an embodiment of the present invention.
Figure 2:
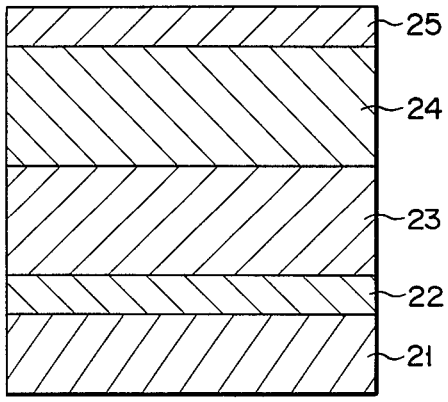

An embodiment of the present invention will now be described in detail. FIGS. 1 and 2 are partial sectional views showing an electrophotographic photosensitive member according to the embodiment. In FIG. 1, barrier layer 22 and a photoconductive layer are formed over conductive substrate 21. The photoconductive layer includes first layer 23 formed of μc-Si, at least a part of which contains hydrogen, and second layer 24 laid on the first layer and formed of a-Si which contains hydrogen and at least one element selected from carbon, oxygen, and nitrogen. Barrier layer 22 is sandwiched between substrate 21 and the photoconductive layer including first and second layers 23 and 24. In FIG. 2, surface layer 25 is formed on the photoconductive layer.

First layer 23 of the photoconductive layer is formed mainly of μc-Si, which is more or less of an n-type. Therefore, layer 23 is preferably light-doped (to $10^{-7}$ to $10^{-3}$ atomic percent) with an element included in group III of the periodic table. The doping converts layer 23 to an i-type (intrinsic) semiconductor, whose dark resistance is high and whose signal-to-noise ratio and chargeability are improved. Also, layer 23 preferably contains at least one element selected from carbon, oxygen, and nitrogen, so that the photosensitive member has improved electric charge-retentivity.

Barrier layer 22 serves to prevent injection of electrons or holes from substrate 21 into the photoconductive layer, when in darkness. When irradiated, layer 22 allows a charge produced in the photoconductive layer to pass to the side of substrate 21 at a high rate. The barrier layer, which is formed of μc-Si, is doped with an element included in group III or V of the periodic table, to be converted to a p- or n-type semiconductor. Preferably, the doping element content of layer 22 ranges from $10^{-3}$ to 10 atomic percent. If layer 22 contains at least one element selected from carbon, oxygen, and nitrogen, at a rate of 0.1 to 20 atomic percent, it has further improved charge blocking capability and therefore, improved electrophotographic characteristics. The thickness of barrier layer 22 preferably ranges from 0.01 to 10 μm, more preferably from 0.1 to 2 μm.

As shown in FIG. 2, surface layer 25, which is provided on second layer 24 of the photosensitive member, is formed of a-Si containing at least one element selected from carbon, oxygen, and nitrogen. Thus, the surface of the photoconductive layer is protected, and has improved environmental durability and chargeability. The carbon, oxygen and/or nitrogen content of the layer preferably ranges from 10 to 50 atomic percent.

In the present invention, first layer 23 is formed of μc-Si, containing mainly hydrogen, and second layer 24 of a-Si, containing hydrogen and at least one element selected from carbon, oxygen, and nitrogen. Layer 24 has higher sensitivity to visible radiation, while layer 23 has higher sensitivity to near-infrared radiation. Combining these first and second layers, the photoconductive layer enjoys high resistance and improved chargeability. Moreover, it has extremely high photosensitivity in a wide range of wave-lengths covering both visible radiation and near-infrared radiation (e.g., centering around a wavelength of 790 nm, equivalent to the oscillation wavelength of a semiconductor laser). Thus, the photosensitive member can be used for both plain paper copiers (PPC) and laser printers. The arrangement of the first and second layers is not limited to the one shown in FIGS. 1 and 2, in which first layer 23 is formed on the substrate side and second layer 24 on the surface layer side. Alternatively, the order of the arrangement may be reversed. For the sake of photosensitivity, however, layer 24, formed of a-Si, should preferably be on the surface layer side. The reason is that if the μc-Si layer is on the surface side, it absorbs visible rays, somewhat diminishing the useful effects of the a-Si layer. The carbon, oxygen, or nitrogen content of layers 23 and 24 preferably ranges from 0.1 to 20 atomic percent. The thickness ratio between the two layers may suitably be selected. Preferably, first layer 23 is 0.1 μm thick or more, and second layer 24 is 2 μm thick or more. The photoconductive layer, formed by the first and second layers, has a thickness ranging from 3 to 80 μm, preferably from 10 to 50 μm.

The μc-Si preferably contains 0.1 to 30 atomic persent of hydrogen. Thus, the dark and light resistances are well-matched for improved photoconductive characteristics. In doping the μc-Si layer with hydrogen by, for example, the glow discharge decomposition process, by $SiH_4$, $Si_2H_6$ or other silane gas, as a material gas, and hydrogen, as a carrier gas, are introduced into a reaction container for glow discharge. Alternatively, the gas mixture for the reaction may be a combination of hydrogen gas and silicon halide, such as $SiF_4$, $SiCl_4$, etc., or of silane gas and silicon halide. Moreover, the μc-Si layer may be formed by sputtering or other physical method, as well as by the glow discharge decomposition process. In view of the photoconductive characteristics, the photoconductive layer including μc-Si preferably has a thickness 1 to 80 μm, more preferably 10 to 50 μm.

The photoconductive layer may be formed substantially wholly from μc-Si or from a mixture of laminate structure of a-Si and μc-Si. The laminate structure has higher chargeability, while the mixture has higher sensitivity to light with a long wavelength corresponding to the infrared region. These two structures are substantially equal in sensitivity to visible radiation. Thus, the layer may be formed in an alternative manner, depending on the application of the photosensitive member.

Also, the μc-Si layer preferably contains at least one element selected from carbon, oxygen, and nitrogen, so that the photosensitive member has improved electric charge-retentivity. The doping element or elements act as a terminator for silicon dangling bonds. Thus, the state density of the dangling bonds in forbidden bands between energy bands are lowered, so that dark resistance is increased.

Barrier layer 22 suppresses the charge-flow between conductive substrate 21 and the photoconductive layer (first and second layers 23 and 24), thereby increasing the charge-retentivity of the surface of the photosensitive member and its chargeability. In positively charging the photosensitive member surface according to the Carlson process, the barrier layer is converted to a p-type semiconductor, in order to prevent electrons from being injected into the photoconductive layer from the substrate side. In negatively charging the surface, on the other hand, the barrier layer is changed to an n-type semiconductor, in order to prevent holes from being injected into the photoconductive layer from the substrate side.

Surface layer 25 is preferably formed on the photoconductive layer. Since μc-Si or a-Si of the photoconductive layer has a relatively high refractive index of 3 or 4, the layer surface is liable to reflect light. If such light reflection occurs, the volume of light absorbed by the layer is lowered, increasing the loss of light. Preferably, therefore, surface layer 25 is used to prevent such reflection. Layer 25 also serves to protect the photoconductive layer against damage and thereby improve the chargeability of its surface. Thus, the photoconductive layer or charge generating layer has improved environmental durability. The layer 25 preferably contains at least one element selected from carbon, oxygen, and nitrogen, with a content of 10 to 50 atomic percent. The thickness of surface layer 25 preferably ranges from 0.01 to 10 μm, and more preferably from 0.1 to 2 μm.

The electrophotographic photosensitive member is not limited to the aforementioned arrangement, in which the substrate, barrier layer, photoconductive layer, and surface layer are stacked in succession. For example, it may be of a separate-function configuration, such that a charge-transport layer (CTL) is formed on a substrate, and a charge-generating layer (CGL) is formed on the CTL. In this case, a barrier layer may be interposed between the CTL and the substrate. The CGL (corresponding to the second layer) generates carriers when irradiated. It is partially or wholly formed of a-Si, and its thickness preferably ranges from 0.1 to 10 μm. The CTL (corresponding to the first layer) is a layer which causes the carriers generated in the CGL to reach the substrate side at a high rate. Accordingly, the carriers must have high mobility and transportability, as well as a long life. The CTL is formed of μc-Si. To improve its dark resistance for higher chargeability, it is preferably light-doped with an element included in either group III or V of the periodic table. For further improved chargeability and double function for both layers, the CTL may contain carbon, nitrogen and/or oxygen. If it is too thin or too thick, the CTL cannot satisfactorily fulfill its function. Preferably, it has a thickness of 3 to 80 μm. The barrier layer serves to improve the charge-retentivity and chargeability of even the separate-function photosensitive member. The conductivity type of the barrier layer depends on its charging characteristic. The barrier layer is formed of μc-Si.

Figure 3:
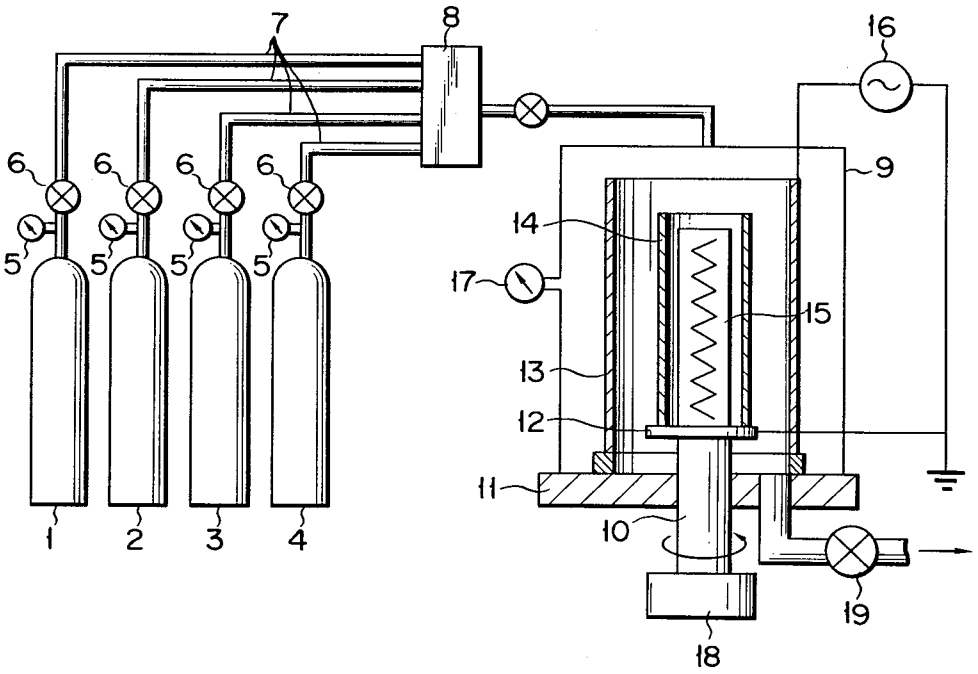
FIG. 3 shows an apparatus for manufacturing the photosensitive members of the invention.

FIG. 3 shows an apparatus for manufacturing the electrophotographic photosensitive member according to the present invention. Gas cylinders 1, 2, 3 and 4 contain material gases such as $SiH_4$, $B_2H_6$, $H_2$ and $CH_4$, respectively. The gases in cylinders 1 to 4 are fed into mixer 8 through pipes 7. Each cylinder is provided with a pressure gage 5. The flow rate and mixture ratio of the material gases supplied to mixer 8 can be adjusted by controlling valve 6, while watching the pressure gage. The gas mixture resulting from mixing in mixer 8 is fed into reaction container 9. Rotating shaft 10 is attached to bottom portion 11 of container 9, so as to be rotatable around a vertical axis. Disk-shaped support 12 is fixed to the upper end of shaft 10, so that its surface extends at right angles to the shaft. Inside container 9, cylindrical electrode 13 is mounted on portion 11, so as to be coaxial with shaft 10. Drum base 14 of the photosensitive member is mounted on support 12, with its axis in alignment with that of shaft 10. Drum base heater 15 is located in the drum base. High-frequency power source 16 is connected between electrode 13 and base 14, whereby high-frequency current is supplied between the two. Shaft 10 is rotated by motor 18. The pressure inside reaction container 9 is monitored by pressure gage 17, and the container is coupled to a suitable exhaust means, such as a vacuum pump, through gate valve 19.

In manufacturing the photosensitive member by means of the apparatus constructed in this manner, drum base 14 is set in reaction container 9, and gate valve 19 is then opened to gas-purge the container to a pressure of 0.1 torr or less. Then, the necessary reaction gases from cylinders 1 to 4 are mixed at a predetermined mixture ratio and introduced into container 9. In this case, the flow rate of the gas mixture fed into container 9 is set so that the pressure inside the container ranges from 0.1 to 1 torr. Subsequently, motor 18 is started, to rotate drum base 14, and the base is heated to a set temperature. At the same time, high-frequency power source 16 supplies high-frequency current between electrode 13 and base 14, thereby causing glow discharge between them. As a result, microcrystalline silicon ($\mu$c-Si) is deposited on drum base 14. The $\mu$c-Si layer can be made to contain elements included in $NH_3$, $NO_2$, $N_2$, $CH_4$, $C_2H_4$, and $O_2$ gases, by using these gases as the material gases.

Thus, the electrophotographic photosensitive member according to the present invention, like the prior art one using a-Si, can be made by the use of a closed-type manufacturing apparatus, which is highly safe. Highly resistant to heat, moisture, and wear, the photoconductive layer of the member can stand prolonged, repeated use with less deterioration, ensuring a long life. Moreover, there is no need of a sensitizing gas, such as $GeH_4$, for enhancing the sensitivity to long-wavelength light. Therefore, it is not necessary to provide any exhaust-gas processing equipment. Thus, the efficiency of the industrial production process is very high.

Examples of the present invention will now be described.

EXAMPLE 1

After an aluminum drum, for use as a conductive substrate, was washed and dried, it was heated to 350° C. while the reaction container was being gas-purged by a diffusion pump. After about one hour of heating, the vacuum level in the container reached $3\times10^{-5}$ torr, whereupon the drum temperature was stabilized. Then, 300 SCCM of $SiH_4$ gas, $B_2H_6$ gas with a $5\times10^{-4}$ flow-rate ratio to the $SiH_4$ gas, 60 SCCM of $CH_4$ gas, and 200 SCCM of argon gas were mixed and fed into the reaction container. High-frequency power of 200 W was applied to the gas mixture at 13.56 MHz for 2 minutes of glow discharge. Thereafter, the flow rate of the $CH_4$ gas was lowered to 30 SCCM for 30 seconds of filming, and then to 10 SCCM for another 30 seconds of filming. Thus, barrier layer 21 was completed. The pressure inside the reaction container, at that time, was approximately 0.8 torr, and the layer thickness obtained was 1.2 $\mu$m.

Subsequently, all the gas flows were stopped, and the reaction container was gas-purged for 15 minutes. Thereafter, the flow rates of the $SiH_4$ gas and hydrogen gas were set to 600 SCCM and 500 SCCM, respectively, and the ratio of flow rate between $B_2H_6$ and $SiH_4$ was adjusted to $8\times10^{-8}$. Then, high-frequency power of 350 W was applied at a reaction pressure of 1.5 torr, to form first layer 23 of $\mu$c-Si, with a thickness of 25 $\mu$m.

Subsequently, 600 SCCM of $SiH_4$ gas and 150 SCCM of $CH_4$ gas were fed continuously for 5 minutes. After the gas flow stabilized, high-frequency power of 350 W was applied at a reaction pressure of 1.2 torr, to form second layer 24 of a-Si, containing carbon, with a thickness of 5 $\mu$m. Then, all the gas flows were stopped, and the reaction container was gas-purged for 15 minutes. Thereafter, the flow rates of the $SiH_4$ gas and $CH_4$ gas were set to 100 SCCM and 400 SCCM, respectively, and high-frequency power of 200 W was applied at a reaction pressure of 0.7, torr, to form surface layer 25, of 1.5-$\mu$m.

A laser printer, mounted with a semiconductor laser of 790-nm oscillation wavelength, was used to form an image on the photosensitive member filmed in this manner. The resultant image was a distinct one, high in resolution, and free from fog and unevenness in density. As for its electrophotographic characteristics, photosensitivity was as high as 10 erg/cm$^2$. When a 1,000-cycle repeat test was conducted, at a temperature of 25° C. and a humidity of 55 percent, the surface potential dropped by 30 V, and the residual potential drop was able to be held down to 2 V, after exposure at 40 erg/cm$^2$.

EXAMPLE 2

This example differs from example 1 only in that 150 SCCM of oxygen gas was used in place of $CH_4$ gas, to form the second layer of the photoconductive layer. Thus, the resultant second layer was formed of a-Si containing oxygen. High photoconductivity characteristics were obtained also in this case.

EXAMPLE 3

This example differs from example 1 only in that 150 SCCM of $NH_3$ gas was used in place of $CH_4$ gas, to form the second layer of the photoconductive layer. Thus, the resultant second layer was formed of a-Si containing nitrogen. High photoconductivity characteristics were obtained also in this case.

What is claimed is:

1. An electrophotographic photosensitive member comprising:

a conductive substrate;

a barrier layer provided on the conductive substrate, said barrier layer comprises microcrystalline silicon containing hydrogen, an element included in group III or V of the periodic table, and at least one element selected from carbon, oxygen, and nitrogen; and a photoconductive layer provided on the barrier layer, said photoconductive layer including a first layer comprised of microcrystalline silicon, at least a part of which contains hydrogen, and a second layer comprised of amorphous silicon containing hydrogen and at least one element selected from carbon, oxygen, and nitrogen, said first and second layers being stacked on top of the photoconductive layer.

2. The electrophotographic photosensitive member according to claim 1, wherein said photoconductive layer contains an element included in group III of the periodic table.

3. The electrophotographic photosensitive member according to claim 1, wherein said first layer contains at least one element selected from carbon, oxygen, and nitrogen.

4. The electrophotographic photosensitive member according to claim 1, wherein said first layer includes microcrystalline silicon regions and amorphous silicon regions distributed mixedly.

5. The electrophotographic photosensitive member according to claim 1, wherein said first layer includes a microcrystalline silicon layer and an amorphous silicon layer, stacked for lamination.

6. The electrophotographic photosensitive member according to claim 1, wherein the hydrogen content of each of said barrier layer and said first layer ranges from 0.1 to 30 atomic percent.

7. The electrophotographic photosensitive member according to claim 2, wherein the group-III element content of said photoconductive layer ranges from $10^{-7}$ to $10^{-3}$ atomic percent.

8. The electrophotographic photosensitive member according to claim 1, wherein the group-III or -V element content of said barrier layer ranges from $10^{-3}$ to 10 atomic percent.

9. The electrophotographic photosensitive member according to claim 1, wherein the content of the at least one element selected from carbon, oxygen, and nitrogen of each of said barrier layer and said second layer ranges from 0.1 to 20 atomic percent.

10. The electrophotographic photosensitive member according to claim 1, wherein the thicknesses of said first and second layers are not less than 0.1 micrometer and 2 micrometers, respectively, and the thickness of said photoconductive layer ranges from 3 to 80 μm.

11. The electrophotographic photosensitive member according to claim 1, wherein the thickness of said barrier layer ranges from 0.01 to 10 μm.

12. The electrophotographic photosensitive member according to claim 1, further comprising a surface layer of amorphous silicon formed on the photoconductive layer.

13. The electrophotographic photosensitive member according to claim 12, wherein said surface layer contains at least one element selected from carbon, oxygen, and nitrogen.

14. The electrophotographic photosensitive member according to claim 13, wherein the content of the at least one element selected from carbon, oxygen, and nitrogen, of said surface layer, ranges from 10 to 50 atomic percent.

* * * * *